United States Patent [19]

Takei et al.

[11] Patent Number: 4,635,433

[45] Date of Patent: Jan. 13, 1987

[54] UNBONDED PC STEEL STRAND

[75] Inventors: Masamitsu Takei; Shigeo Shoji, both of Chiba, Japan

[73] Assignees: Kawasaki Steel Corporation, Hyogo; Kawatetsu Wire Products, Tokyo, both of Japan

[21] Appl. No.: 799,157

[22] Filed: Nov. 18, 1985

[30] Foreign Application Priority Data

Nov. 20, 1984 [JP] Japan ..... 59-243459

[51] Int. Cl.[4] ..... D07B 1/16; D07B 1/14

[52] U.S. Cl. ..... 57/223; 57/7

[58] Field of Search ..... 57/210, 223, 232, 234, 57/7, 295, 297; 52/230

[56] References Cited

U.S. PATENT DOCUMENTS 3,646,748 3/1972 Lang ..... 57/223
3,899,384 8/1975 Kelly ..... 57/223 X
3,922,437 11/1975 Kitta et al. ..... 57/223 X
3,988,884 11/1976 Kikugawa ..... 57/223 X
4,445,321 5/1984 Hutchinson ..... 57/223

*Primary Examiner*—Donald Watkins
*Attorney, Agent, or Firm*—Austin R. Miller

[57] ABSTRACT

An unbonded PC steel strand used for posttensioning concrete comprising a PC steel strand composed of a plurality of stranded wires, a zinc plated layer on the outer surface of the PC steel strand, a greaselike filler applied around the zinc plated layer, and a synthetic resin sheath covering the zinc and filler coated PC steel strand. A method of manufacturing the unbonded PC steel strand comprising steps of pickling and water washing the PC steel strand, coating the outer surface of the PC steel strand with flux, plating the outer surface of the PC steel strand with zinc, applying a greaselike corrosion inhibitor to the surface of the zinc plated layer and sheathing the PC steel strand with an outer synthetic resin sheath.

2 Claims, 5 Drawing Figures

UNBONDED PC STEEL STRAND

BACKGROUND OF THE INVENTION

1. Field of the Invention

The present invention relates to unbonded PC (prestress concrete) steel strands having a plastic sheath and used for posttensioning concrete structures, and to a process for making such unbonded PC steel strand.

2. Related Art Statement

In general, unbonded PC steel strands having a plastic sheath have been used for preventing the PC steel strands from bonding to concrete in posttensioning of concrete structures in which the PC steel strands placed in concrete are stretched to produce stress in the concrete structures after hardening of concrete.

Conventional unbonded PC steel strands have a corrosion inhibitor such as a greaselike filler between the PC steel strands and their plastic sheaths for improving corrosion protection and lubricity of the PC steel strands as described, for instance, in Japanese Utility Model Application Publication No. 1,160/67, in which the PC steel strand is coated with a filler such as grease or vaseline having fluidity and then helically wrapped with paper tapes and further continuously covered with a synthetic resin sheath having a certain thickness over the whole length of the steel stranded wire, or in U.S. Pat. No. 3,646,748, in which the PC steel strand is coated with a greaselike corrosion inhibitor of a predetermined thickness, and then covered with a flexible synthetic resin sheath.

The prior unbonded PC steel strands filled with greaselike filler between PC steel strands and their sheaths, however, have many problems: The filler penetrates into gaps between stranded wires during the coating operation, increasing the amount of the filler expended in production. Grease adhering to both ends of the PC steel strands must be wiped off at an expenditure of time and labor in order to positively anchor both ends of the PC steel strands in use, and, because complete removal of grease is extremely difficult, positive anchoring of the ends of the PC steel strand cannot be obtained. Furthermore, if the PC steel strands are obliquely or curvedly tensioned, tensile stress of the strands decreases in accordance with increase in the distance from the anchored end, and the decreasing degree of this tensile stress naturally varies in accordance with curvature and angular change of the standard wire. A serious disadvantage arises due to a different coefficient of friction of the PC steel strand to a sheath wall, particularly because of non-uniform distribution of the filler in the space between the wires of the strand and the sheath. Therefore, the problem arises that it is difficult to ensure uniform and complete tension over long periods of time.

Further, there is a problem that the anchored portions are apt to rust as a result of wiping off grease from both anchored end portions of the PC steel strand.

The above U.S. Patent specification also discloses application of a thin coating of a polymer selected from the group consisting of tetrafluoroethylene and copolymers of tetrafluoroethylene with 5 to 35% hexafluoropropylene to the outer surface of the steel strand. Application of such Teflon synthetic resin coating can reduce consumption of the greaselike filler and solve the problem of wiping off grease, but there remains a problem that the greaselike filler does not enter between wires of the PC steel strand and corrosion protection of the PC steel strand wire by the greaselike filler cannot be obtained.

SUMMARY OF THE INVENTION

An object of the invention is to solve the above problems and to provide an improved unbonded PC steel strand comprising a PC steel strand composed of a plurality of stranded wires, a zinc plated layer on the outer surface of the PC steel strand, having a thickness which allows breaking of the zinc-plated layer when the PC steel strand is stretched for postensioning concrete, so that a greaselike corrosion inhibitor or similar fluid, anticorrosive material, which is provided between the zinc-plated layer and an outer synthetic resin sheath can enter into the spaces between wires after posttensioning of concrete, and a synthetic resin sheath covers the zinc-coated, grease filler-covered PC steel strand.

A method of manufacturing an unbonded PC steel strand according to the invention is that the PC steel strand is pickled and washed with water, the outer surface of the PC steel strand is thereafter coated with flux and dried, then subjected to zinc plating by dipping into molten zinc at 440°–480° C., preferably 455° C., for more than 5 seconds, preferably 30 seconds, excessively plated portions are treated by wiping with charcoal, zinc chloride, or gas, and thereby a zinc plating is coated on the outer surface of the PC steel strand in a thickness of 5–100 μm, preferably 30 μm at the wire outer surface portions, without any gap at the wire groove portions.

The outer surface of the zinc plated layer is then coated with a greaselike corrosion inhibitor and further covered with an outer synthetic resin sheath.

According to the invention, at the time of production, a greaselike filler is provided between the zinc-plated layer and the synthetic resin sheath, but does not enter into the gaps between stranded wires, so that a grease layer having a predetermined thickness can be provided with a comparatively small amount or a predetermined amoount of grease, and the covering by the sheath can easily be carried out.

Further, the thickness of the zinc plated layer is such that the zinc plated layer at the groove portions is broken when the PC steel strand is stretched upon posttensioning after the concrete hardens, bringing about direct contact of the greaselike filler with the PC steel strand for the first time after posttension, thereby providing anticorrosion protection of the PC steel stranded wires by penetrating into each gap between wires of the PC steel strand.

When anchoring both ends of the PC steel strand, even if the grease is removed, the anchored end portions are protected by the zinc plated layer, so that rusting of the anchored end portions is effectively prevented.

DESCRIPTION OF THE PREFERRED EMBODIMENT

Figure 1:
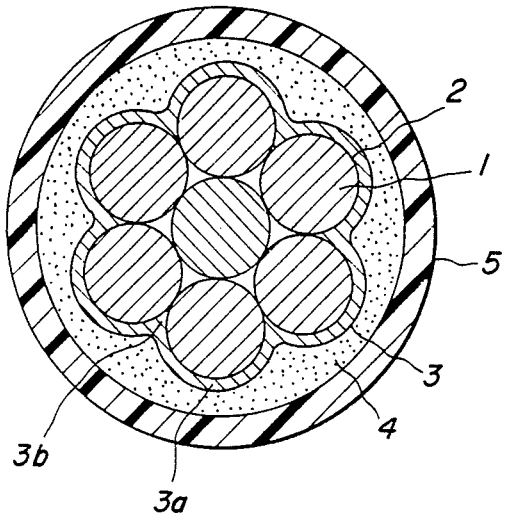
FIG. 1 is a cross-sectional view of an unbonded PC steel strand according to the invention.

The present invention will be explained in more detail referring to the drawings.

Referring to FIG. 1, the unbonded PC steel strand includes a PC steel strand 2 composed of a plurality of wires 1 which are helically stranded. The outer surface of the PC steel strand 2 is plated with zinc. To the plated zinc layer 3 is applied a filler 4 such as a greaselike corrosion inhibitor around the outer surface of the plated zinc layer 3. The PC steel strand 2 coated with a layer or layers of zinc 3 and the filler 4 is sheathed with a continuous tubular synthetic resin sheath 5. The thickness of the plated zinc layer 3 is so determined that the zinc layer 3 will not be broken at the time of manufacture, transportation, handling, and storage, but that the zinc layer 3 will break when the PC steel strand is tensioned for posttensioning of concrete. The thickness of the coating is preferably sufficient to resist friction between the PC steel strand 2 and the sheath 5 and the coating itself possesses an anticorrosive effect.

As the filler 4 between the zinc layer 3 and the sheath 5, use may be made of not only the above described greases but also any other corrosion inhibitor possessing fluidity in the same manner.

Figure 2:
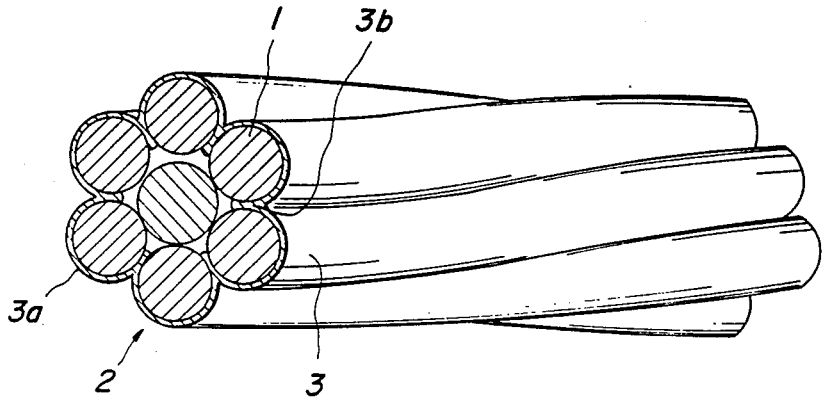
FIG. 2 is a side view of the PC steel strand plated with zinc according to the invention.
Figure 3:
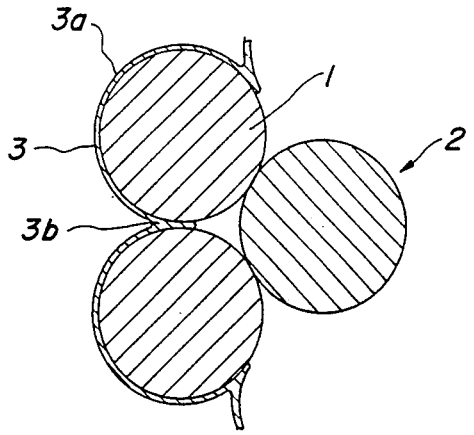
FIG. 3 is a partial enlarged cross-sectional view of the PC steel strand shown in FIG. 2.
Figure 4:
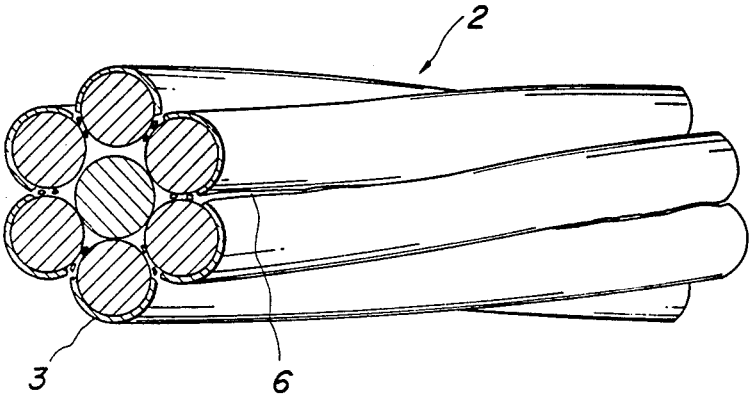
FIG. 4 is a side view similar to FIG. 2 showing the location and character of the cracks produced in the zinc plated layer by stretching the PC steel strand.
Figure 5:
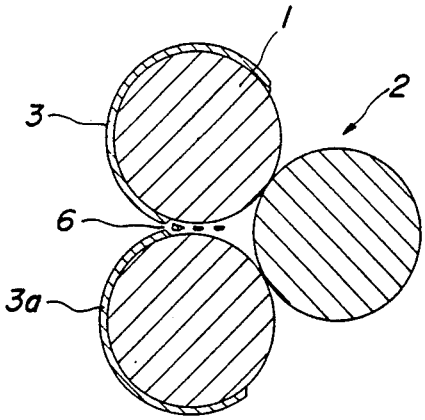
FIG. 5 is a partial enlarged cross-sectional view of the PC steel strand shown in FIG. 4.

FIGS. 2 and 3 show a side view and a partial enlarged cross-sectional view of the PC steel strand 2 plated with zinc. The outer surface portion 3*a* of the zinc layer in this example is approximately 30 μm in thickness. FIGS. 4 and 5 show the state of cracking 6 at a groove portion 3*b* of the zinc layer 3 when the PC steel strand was subjected to a tension of 70% (0.8% elongation) of the strand breaking strength. As a comparative test, the PC steel strand coated with Teflon synthetic resin having 10 μm thickness was subjected to the same tension, but no cracking was produced in the coating.

What is claimed is:

1. An unbonded PC steel strand comprising a PC steel strand composed of a plurality of stranded wires, a zinc plated layer on the outer surface of the PC steel strand, said zinc plated layer having a thickness of 5–100 μm at the wire outer surface portion, and being breakable when the PC steel strand is subjected to the tension applied for posttensioning concrete, said thickness preventing breaking of said layer during manufacture, shipping, handling and storage, a greaselike or other anticorrosive lubricative filler covering the zinc plated layer, and a synthetic resin sheath covering the zinc plated, filler-covered PC steel strand.

2. A method of manufacturing an unbonded PC steel strand comprising a PC steel strand composed of a plurality of stranded wires, a zinc layer plated on the outer surface of the PC steel strand, the plated layer having a thickness of 5–100 μm at the wire outer surface portion, a layer of greaselike or other anticorrosive lubricative filler applied on the outer surface of the zinc plated layer, and a synthetic resin sheath covering the zinc plated filler covered PC steel strand, which method comprises the steps of pickling and water washing the PC steel strand, coating the outer surface of the PC steel strand with flux, plating the outer surface of the PC steel strand with zinc, applying a greaselike corrosion inhibitor to the surface of the zinc plated layer, and sheathing the PC steel strand with an outer synthetic resin sheath.

* * * * *